US005903936A

United States Patent [19]

Kato

[11] Patent Number: 5,903,936

[45] Date of Patent: May 18, 1999

[54] FITTING FOR AN APPLIANCE SUCH AS A SINK

[75] Inventor: Hisanori Kato, Frankfurt, Germany

[73] Assignee: YKK Corporation, Tokyo, Japan

[21] Appl. No.: 08/893,515

[22] Filed: Jul. 11, 1997

[30] Foreign Application Priority Data

Jul. 12, 1996 [GB] United Kingdom ..... 9614663

[51] Int. Cl.[6] ..... E03C 1/33

[52] U.S. Cl. ..... 4/633; 4/631; 4/634

[58] Field of Search ..... 4/631, 633, 634; 224/331; 254/4 R, 4 B, 134.3 CL; 269/37, 285; 24/306

[56] References Cited

U.S. PATENT DOCUMENTS

| | | | |
|---|---|---|---|
| 3,229,310 | 1/1966 | Ensch . | |
| 3,893,725 | 7/1975 | Coulter et al. | 24/306 |
| 5,289,619 | 3/1994 | Pileggi | 24/306 |
| 5,664,265 | 9/1997 | Gätter et al. | 4/633 |

FOREIGN PATENT DOCUMENTS

| | | |
|---|---|---|
| 678 468 | 1/1966 | Belgium . |
| 128 772 | 12/1984 | European Pat. Off. . |
| 674 055 | 12/1994 | European Pat. Off. . |
| 748 601A1 | 12/1996 | European Pat. Off. . |
| 27 55 972 | 2/1979 | Germany . |
| 30 40 180 A1 | 5/1982 | Germany . |
| 3 110 134 | 10/1982 | Germany . |
| 2 219 498 | 12/1989 | United Kingdom . |

*Primary Examiner*—David J. Walczak
*Assistant Examiner*—Tuan N. Nguyen
*Attorney, Agent, or Firm*—Hill & Simpson

[57] ABSTRACT

The present invention pertains to a fitting for an appliance such as a sink. A first anchor is clipped onto a hanger of a sink rim by a nib. A second L-shaped anchor engages the underside of the worktop and is pulled towards the first anchor by a strap of surface fastener material which is locked fast by engaging the surface fastener elements. The second anchor has arms which are guided in channels in the first anchor.

12 Claims, 3 Drawing Sheets

FITTING FOR AN APPLIANCE SUCH AS A SINK

BACKGROUND OF THE INVENTION

1. Field of the Invention

The present invention relates to a fitting for a fixing an appliance on a worktop and in particular to a fitting for fixing an appliance such as a sink or basin in place in a cut out in a worktop.

2. Description of the Prior Art

Existing fitting for fixing a sink in place on a worktop typically comprise a two part hook arrangement. One part is attached to an eye or hanger on the sink, and the other grips the underside of the worktop. The parts are pulled together by a screw to pull the rim of the sink onto the worktop surface. This holds the sink in place and an elastomeric seal is clamped between the rim and worktop surface to provide a water tight seal.

The prior art fittings are expensive, being formed of small metal parts of complex shape and high stiffness, and they are difficult to manipulate in the confines of the cupboard space beneath the sink. Adjustment of the sink during installation is difficult, and the screws may corrode, making it difficult or impossible to release the sink without breaking the fittings or the hanger on the sink.

SUMMARY OF THE INVENTION

With the foregoing difficulties in view, it is therefore an object of the present invention to provide a fitting for fixing an appliance to a worktop which facilitates installment or adjustment of the appliance in a very narrow place, and furthermore facilitates replacement thereof, and which is good in corrosion-resistance.

The present invention provides a fitting for fixing an appliance to a worktop, the appliance having a rim which bears on the worktop upper surface, the fitting comprising a strap, a first anchor means for attachment to the appliance, and a second anchor means for engagement with the worktop, the strap being arranged to pull the first and second another means towards each other, and the second anchor means being shaped to engage the underneath surface of the worktop.

Preferably the first and second anchor means are telescoped together.

The second anchor means may be generally L-shaped, one arm of the "L" shaped cooperating with the first anchor means, and the other arm being arranged to catch the underside of the worktop as the first and second anchors means are pulled together.

Preferably the strap comprises a surface fastener.

The invention will be further described by way of example, with reference to the accompanying drawings, in which

DETAILED DESCRIPTION

Figure 1:
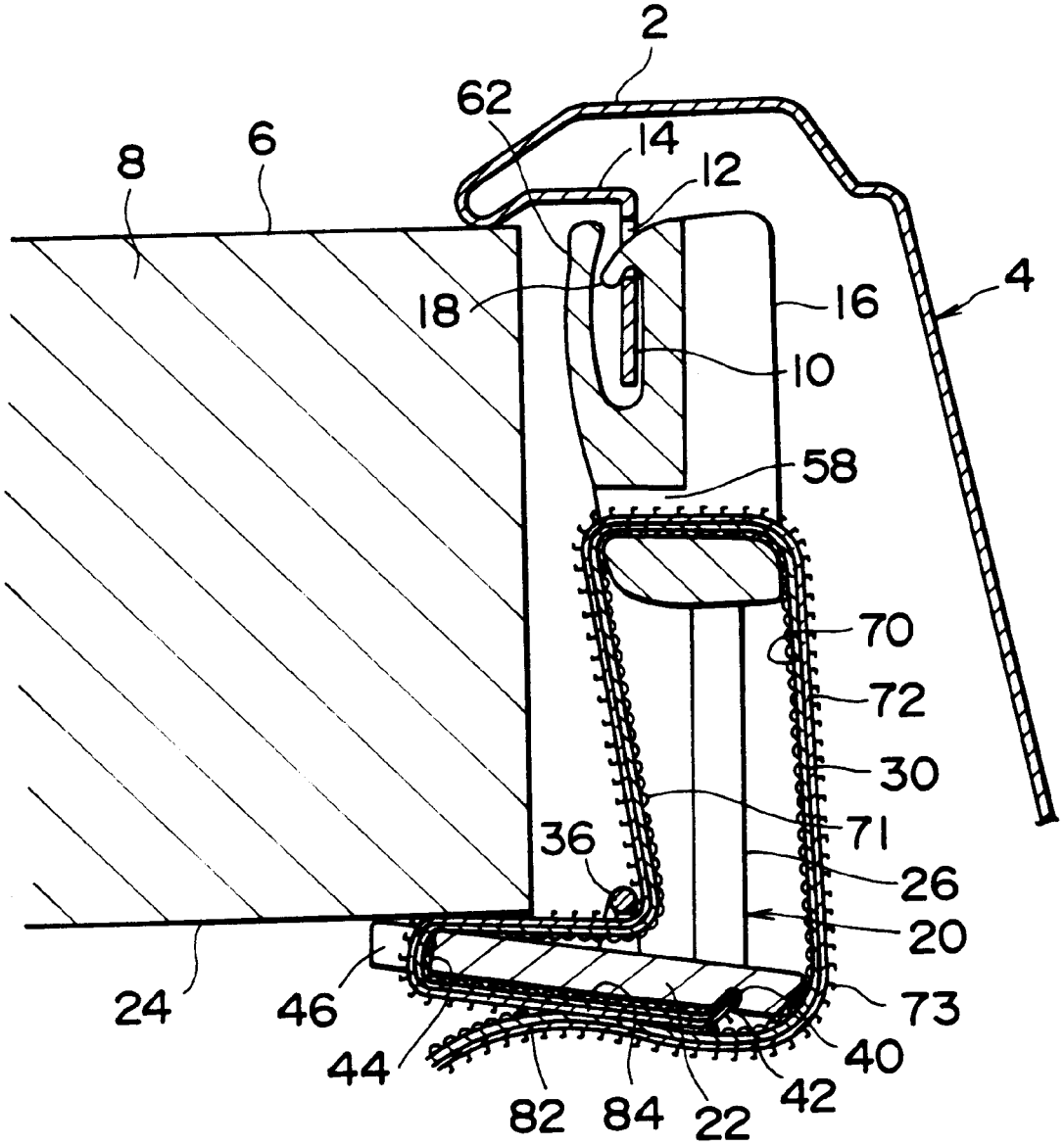
FIG. 1 is a side view of a fitting forming an embodiment of the invention, shown in use.

FIG. 1 shows a pressed-steel rim 2 of a sink 4, bearing on an upper worktop surface 6 of a worktop 8. A hanger 10 having an eye 12 projects down from a re-entrant flange 14 of the rim 2. A first anchor 16 hangs from the hanger 10 by a nib 18 which extends through the eye 12. A second anchor 20 is generally L-shaped and has a generally horizontally extending arm 22 which projects under the underneath surface 24 of the worktop 8 and vertical arms 26 (See FIG. 4) which slide within respective channels 28 in the first anchor 16. A strap 30 formed of surface fastener material (in this case a hook and loop material) pulls the first and second anchors 16, 20 together to urge the sink rim 2 onto the worktop surface 6.

Figure 4:
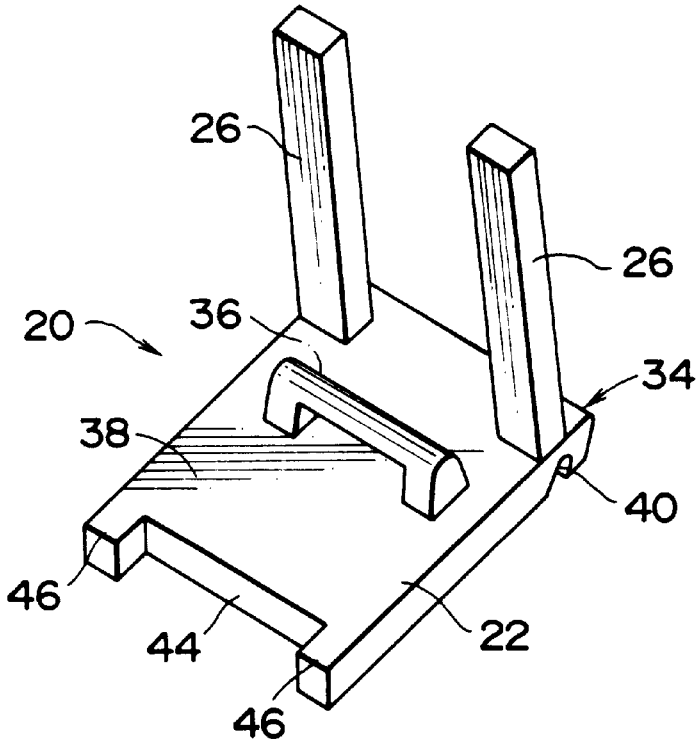
FIG. 4 shows the second anchor of the fitting of FIG. 1.

Referring to FIG. 4, the second anchor 20 is integrally molded of plastics material and comprises a plate-like horizontal arm 22, and two vertical arms 26 extending upwards from a rear edge 34, at an angle of about 80 degrees to the horizontal arm 22. A bar 36 extends parallel to the upper surface 38 of the arm 22. At the underside of the rear edge 34 of the arm 22 a channel 40 is provided to receive an end 42 of the strap 30 (see FIG. 1). Ears 46 on the front edge 44 serve to locate the strap 30, and will also bear on the underneath surface 24 of the worktop 8.

Figure 3:
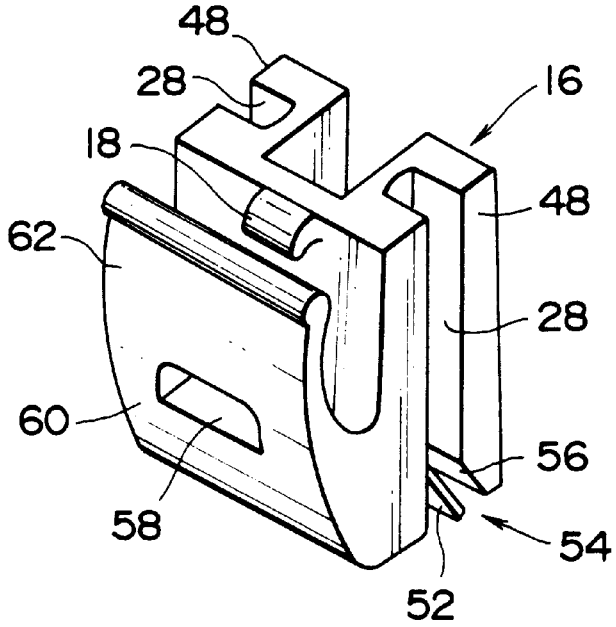
FIG. 3 shows the first anchor of the fitting of FIG. 1.

Referring to FIG. 3, the first anchor 16 is integrally molded of plastics material and has two end walls 48, each having a channel 28 for receiving an arm 26 of the second anchor 20. A flexible lip 52 is formed at the lower end 54 of each channel 28, and the opposing channel wall region 56 is sloped generally parallel to the lip 52, so that an arm 26 will be gently gripped between the lip 52 and wall region 56.

A slot 58 extends through a lower part of the body 60 for passage of the strap 30. The body 60 includes a nib 18 which engages in the eye 14 of the hanger 10, and a resilient front wall 62 which cooperates with the nib 18 to guide the anchor 16 over the hanger 10 and hold it in place.

The strap 30 is formed of strip 70 having loops 71 of loop pile material and a strip 72 hook material having hooks 73, forming a hook and loop fastener system, which are stuck back to back.

Figure 2:
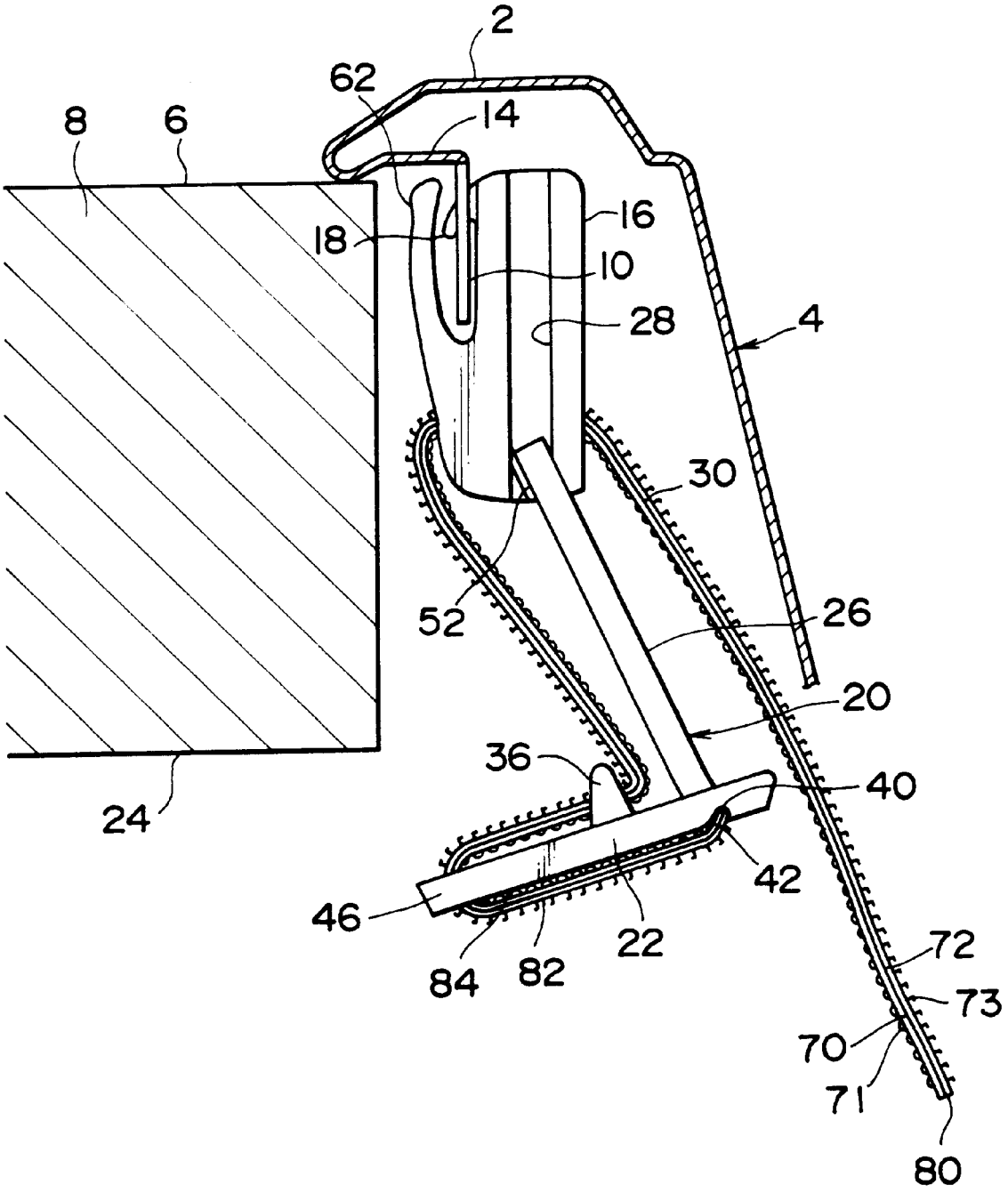
FIG. 2 shows the fitting of FIG. 1, being fitted.

Referring to FIG. 2, the fitting is assembled by clipping the end 42 of the strap 30 into the channel 40, feeding the strap around the front edge 44 of the arm 22 and under the bar 36. The arms 26 are slotted into the lower end of the channels 28, to be gripped by the lips 52, and the strap is fed through the slot 58.

The first anchor 16 is clipped onto the hanger 10. It can be seen that the second anchor 20 slopes away from the worktop 8, making it easier to maneuver the fitting into place.

The anchor 20 is urged upwards, the arms 26 sliding in the slots 28, and pressing the lips 52 back, and the strap 30 is pulled tight by its free end 80. The ears 46 will engage the underside 24 of the worktop 8. The anchor 20 may deform slightly, adding to the resilience of the fitting. The strap 30 is locked by pressing the loop material 70 of free end 80 onto hook material 72 of the strap portion 82 which lays on the underside 84 of the arm 22.

Various modifications may be made. For example, the strap may be glued to the underside 84 of the arm 22 to ensure it is held in place. It will be appreciated that the strap may be attached to the anchor 20 by looping it around the bar 36 for example. The strap may be one part of a surface fastener, for example a loop part, and the complementary part, such as a hook part, may be molded into the underside 84 of the arm 22 or glued in place. The strap need not be formed with surface fastener elements, such as hooks and/or loops, along its full length.

Obviously, the skilled person would realize that various modifications and variations of the present invention are possible in the light of the above teaching. It is therefore to be understood that within the scope of the appended claims the invention may be practiced otherwise than as specifically described, and that the invention is not limited to the embodiments described above in detail.

What is claimed is:

1. A fitting for fixing an appliance to-a worktop, the appliance having a rim which bears on the worktop upper surface, the fitting comprising a strap, first anchor means for attachment to the appliance, and a second anchor means for engagement with the worktop, the first and second anchor means being telescoped together, the strap extending through a slot in a least one of the first and second anchor means and being arranged to pull the first and second anchor means toward each other, and the second anchor means being shaped to engage the underneath surface of the worktop.

2. A fitting as claimed in claim 1, wherein an arm of one anchor means is guided in a channel of the other anchor means.

3. A fitting as claimed in claim 2, therein the first and second anchor means are coupled together in a first relative orientation, and adopt a second relative orientation when they are pulled together by the strap.

4. A fitting as claimed in claim 3, wherein the second anchor means is substantially L-shaped, one arm of the L-shaped extending, in use, under the underneath surface of the worktop.

5. A fitting as claimed in claim 2, wherein the second anchor means is substantially L-shaped, one arm of the L-shaped extending, in use, under the underneath surface of the worktop.

6. A fitting as claimed in claim 1, wherein the first and second anchor means are coupled together in a first relative orientation, and adopt a second relative orientation when they are pulled together by the strap.

7. A fitting as claimed in claim 6, wherein the second anchor means is substantially L-shaped, one arm of the L-shaped extending, in use, under the underneath surface of the worktop.

8. A fitting as claimed in claim 1, wherein the second anchor means is substantially L-shaped, one arm of the L-shaped extending, in use, under the underneath surface of the worktop.

9. A fitting as claimed in any one of claims 1 to 8, wherein the strap is locked by a surface fastener to hold the appliance on the worktop.

10. A fitting as claimed in claim 9, wherein the surface fastener is a hook and loop type fastener.

11. A fitting as claimed in claim 10, wherein the strap comprises a strip of hook and/or loop surface fastener material.

12. A sink fitting comprising:

a first anchor having a sink attaching portion;

a second anchor having a worktop engaging portion, the first and second anchors moveable relative to each other and being telescoped together; and a flexible strap engaged with the first and second anchors and extending through a slot in at least one of the first and second anchors, the first and second anchors biased toward each other by the strap.

* * * * *